US006371520B1

(12) United States Patent
Wolff et al.

(10) Patent No.: US 6,371,520 B1
(45) Date of Patent: Apr. 16, 2002

(54) SLIDE LOCK AND REPORT COVER

(75) Inventors: Scott S. Wolff, Evanston; Stephan Peter James Pfanner, Chicago; James Caruso, Evanston; Bart Massee, Chicago; John A. Zillmer, Northbrook, all of IL (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/346,690

(22) Filed: Jul. 2, 1999

(51) Int. Cl.[7] ..... B42D 3/00

(52) U.S. Cl. ..... 281/29; 281/47; 281/28; 402/8; 402/17

(58) Field of Search ..... 402/8, 19, 17, 402/60, 73; 281/46, 21.1, 35, 36, 29, 47; 24/563, 587

(56) References Cited

U.S. PATENT DOCUMENTS

| | | | | |
|---|---|---|---|---|
| 3,298,374 A | | 1/1967 | Grundell | |
| 4,486,032 A | * | 12/1984 | Leahy | 281/46 |
| 4,682,792 A | | 7/1987 | Simmons | |
| 4,898,405 A | | 2/1990 | Pickering et al. | |
| 4,928,995 A | | 5/1990 | Pickering et al. | |
| 4,934,738 A | | 6/1990 | Colonna | |
| 5,226,676 A | | 7/1993 | Su | |
| D360,221 S | | 7/1995 | Wu | |
| 5,575,505 A | * | 11/1996 | Bridges | 281/36 |
| 5,636,869 A | | 6/1997 | Holmes | |
| D381,041 S | | 7/1997 | Lammers et al. | |
| 5,683,111 A | * | 11/1997 | Bass et al. | 281/21.1 |
| 5,865,469 A | | 2/1999 | Chin | |
| 5,893,585 A | * | 4/1999 | Worthen | 281/45 |

* cited by examiner

*Primary Examiner*—Willmon Fridie, Jr.
(74) *Attorney, Agent, or Firm*—Pennie & Edmonds LLP

(57) ABSTRACT

The present invention is directed to a report cover combination that includes a slide lock. The slide lock includes a wall defining a channel. Two edges define a slit extending through the wall of the slide lock along its length, and the longitudinal ends of the slide lock are sloped toward the slit to facilitate the insertion of a folded edge of a report cover into the slit of the slide lock. Preferably two parallel lips protrude inward from the edges of the slide lock at the slit. The report cover includes front and back covers having an outer surface. The front and back covers are connected by a hinge. At least one protrusion extends from at least one of the covers adjacent the hinge. The hinge of the report cover is insertable into the channel of the slide lock through the slit. The protrusion is configured and dimensioned to catch against the opposing edges of the slide lock such that the report cover resists extraction from the slide lock.

10 Claims, 7 Drawing Sheets

SLIDE LOCK AND REPORT COVER

The present invention is directed to report covers. More particularly, the present invention is directed to reusable report covers having a report cover and a bar adapted to hold papers within the report cover.

BACKGROUND OF THE INVENTION

Report covers have been used to cover papers to keep them clean and unwrinkled. Usually, the report cover is a clear plastic sheet, folded in half, dividing the sheet into front and back covers. Papers are placed between the folded covers. Often a bar is slid over the folded edge to more securely hold the papers within the report cover.

One patent disclosing a report cover is U.S. Pat. No. 4,486,632 to Leahy. This patent teaches a cover folder with a binder that is an elongated bar with an elongated channel having a slit opening. The bar includes ribs on an interior surface of the sidewall slanted inwardly and forming an obtuse angle between the rib and the sidewall closest to the slit opening. The ribs engage a folded-over edge of a cover sheet held within the elongated bar.

Another patent disclosing a report cover is U.S. Pat. No. 476,363 to Burt. The patent teaches a temporary binder having a U-shape with cylindrical-rolled edges that diverge from each other. Wire rods are enclosed within the rolled edges that clip papers to prevent slipping without scratching or tearing the papers.

U.S. Pat. No. 5,865,469 to Chin discloses the use of a cover folder with a binding bar and a cover. The binding bar includes oppositely facing sidewalls extending from a back wall to define a slot. The ends of the sidewalls are shaped to define barbs protruding into the slot. The cover is folded in the middle to form a folded edge separating top and bottom panels and includes a plurality of cutouts which are in the shape of semicircular tabs in the top and bottom panels along the folded edge. The cutouts are formed to catch on the barbs, keeping the cover within the binding bar.

U.S. Pat. No. 4,934,738 to Colonna discloses a document binder and cover holder. A body is formed as an elongated clip having two inner strip members joined lengthwise by a spine, forming a U-shaped channel. Branch members are attached to the strip members and extend toward the spine and terminate adjacent the strip member to which it is attached. Documents are inserted between the strip members. Cover papers are inserted between strip members and the branch members. The cover paper is folded back over the binder and document to form top and bottom covers.

SUMMARY OF THE INVENTION

The present invention includes an extruded slide lock having walls defining a channel. Two edges define a slit that extends through the wall of the slide lock along its length. The longitudinal ends of the slide lock are sloped toward the slit to facilitate the insertion of an edge of a report cover into the slit. Preferably, two parallel lips protrude inward into the channel from the edges of the slide lock at the slit.

The present invention also includes a report cover. The report cover includes front and back covers connected by a hinge. The hinge of the report cover is insertable into the slit of the slide lock. A protrusion preferably is included on at least one of the covers that is insertable within the slide lock to assist in preventing the extraction of the report cover from the slide lock. In one embodiment, the protrusions are two flaps formed by five folds, including the hinge, resulting in a diamond shape that connects front and back covers of the report cover. First and second folds of the diamond are folded forward of the remainder of the diamond and are slidably received in the channel of the slide lock. Also, preferably the upper and lower ends of the report cover adjacent a hinge are notched toward the first and second folds of the diamond, such that the flaps are tapered when folded forward over the covers to facilitate the mounting of the slide lock thereover without catching on the ends of the slide lock.

In another embodiment, the protrusion is a bump or nub formed in the front and back covers substantially along the length and adjacent the hinge. The bump extends outward from the exterior surface of the cover. Preferably, one bump is formed in each cover along the length of the hinge.

BRIEF DESCRIPTION OF THE DRAWINGS

Reference is made to a brief description of the drawings, which are intended to illustrate embodiments of the report cover of the present invention.

DETAILED DESCRIPTION OF THE PREFERRED EMBODIMENTS

Figure 1:
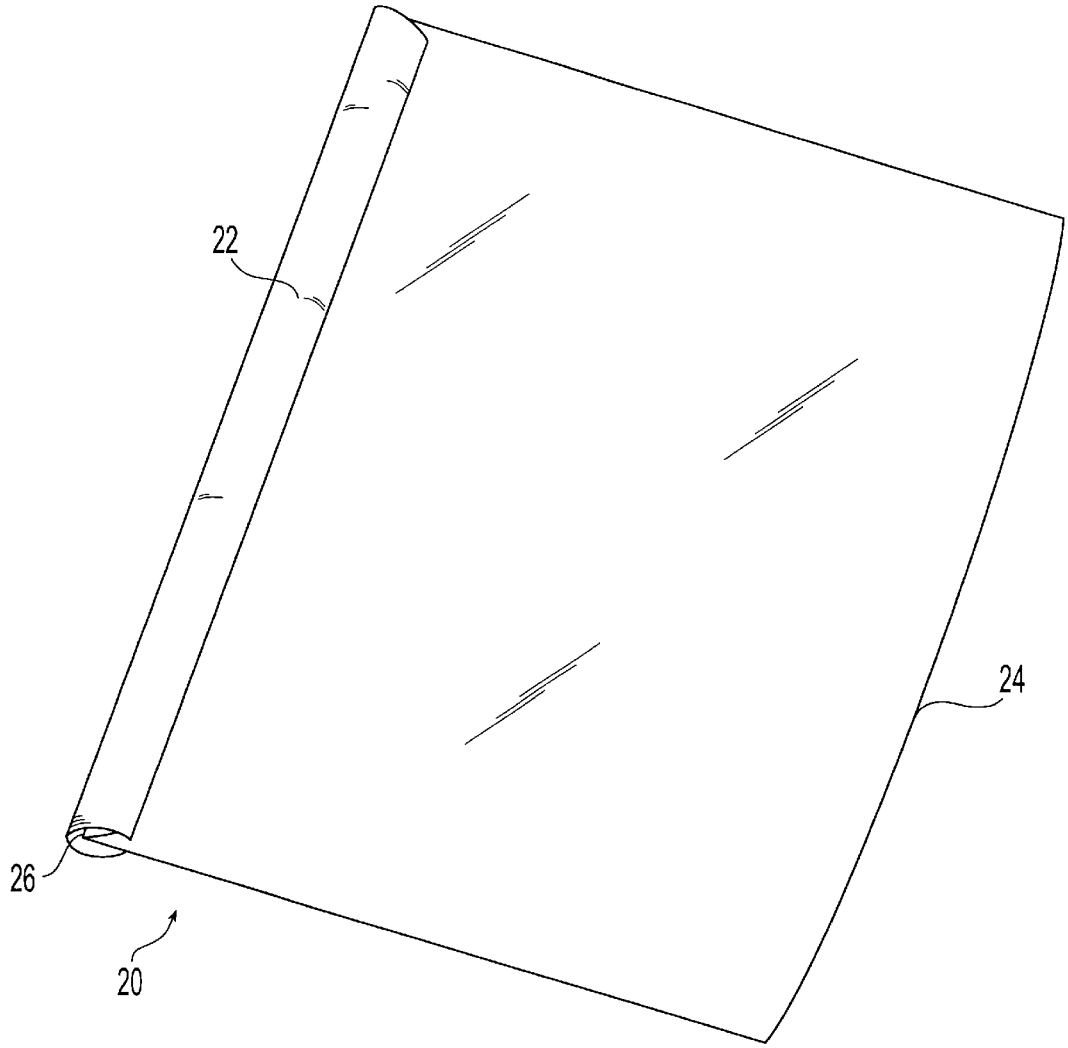
FIG. 1 is a perspective view of the bind report cover according to the present invention.

Referring to FIG. 1, a report cover 20 according to the present invention features a slide lock 22 and a report cover 24. Papers are placed within the report cover 24 and the slide lock 22 is slid over a folded edge 26 of the report cover 24 to clamp and hold the papers within the report cover 24.

Figure 2:
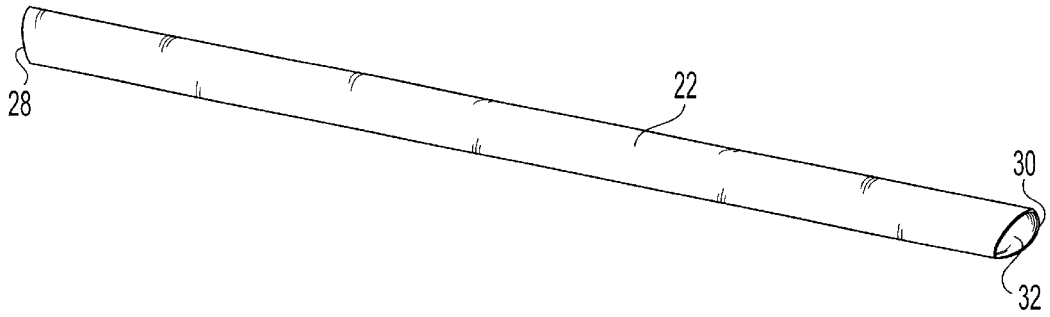
FIG. 2 is a perspective view of the slide lock according to the present invention.
Figure 3:
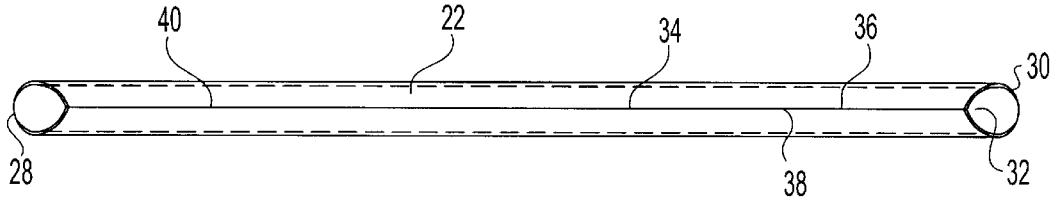
FIG. 3 is a side view of the slide lock according to the present invention.
Figure 4:
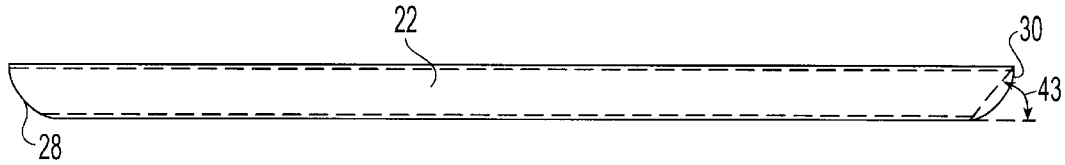
FIG. 4 is a top view of the slide lock according to the present invention.
Figure 4A:
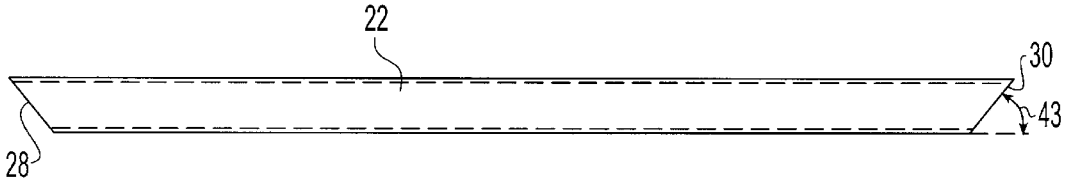
FIG. 4A is a top view of another version of the slide lock according to the present invention.

Referring to FIG. 2, the slide lock or clamp 22 is preferably an elongated elliptical bar having two longitudinal ends 28 and 30. As shown in FIG. 3, the slide lock 22 defines a hollow channel 32 and one portion 34 of the slide lock 22 features two edges 36 and 38 defining a slit 40 therebetween that accommodates and clamps the report cover 24 and papers. Preferably, this slit 40 has a small width and the edges 36 and 38 are biased towards or against each other by the bar and can be in contact in a naturally assumed position of the slide lock 22. As shown in FIGS. 3 and 4, the longitudinal ends 28 and 30 of the slide lock 22 are tapered toward the slit 40. This facilitates insertion of the report cover 24 within the slit 40, as the edge of the report cover inserted is guided along the narrowing space in the ends 28 and 30 towards the slit 40. Preferably as shown in FIG. 4, the ends 28 and 30 are also curved as they taper to the slit 40. However as shown in FIG. 4A, the ends 28 and 30 can be made to taper in a straight line. The ends are preferably tapered at an angle 43 of less than 85 degrees with respect to a longitudinal axis of the slide lock.

Figure 5:
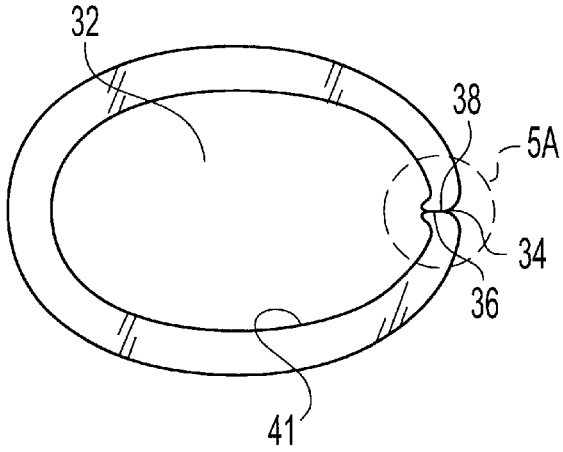
FIG. 5 is an end view of the slide lock according to the present invention.
Figure 5A:
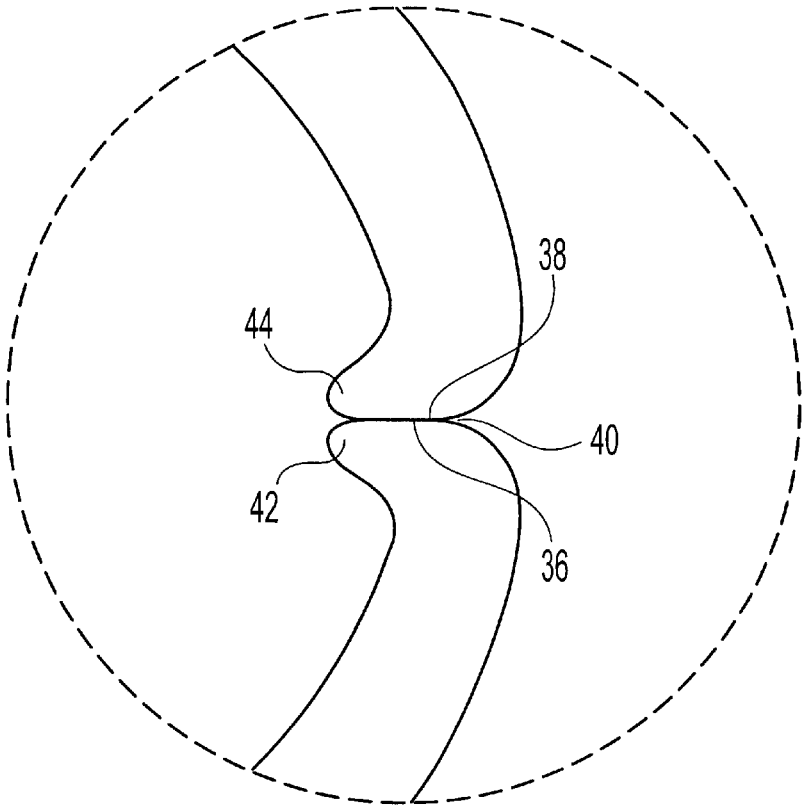
FIG. 5A is a detail of part of the slide lock of FIG. 5.

FIG. 5 is an end view of the slide lock 22. As shown, preferably the slide lock 22 has an elliptical cross-section. Most preferably, as shown, the cross-section is substantially oval shaped. The oval cross-section provides a rigid construction. Other suitable shaped cross-sections may be used such as circular, square, rectangular or any other shape known to those skilled in the art. The slide lock 24 has an inner side wall 41. As shown in FIG. 5A, preferably the edges 36 and 38 of the slide lock 22 defining the slit 40 each feature a lip or projection 42 and 44 located on the edge 36 and 38 that forms the slit 40. The lips 42 and 44 preferably face inward into the channel 32 of the elongated bar 22. As shown, preferably the lips 42 and 44 are in parallel relation to each other. The lips 42 and 44 assist in keeping the report cover 24 within the slide lock 22, such that it will not easily slip out of the slide lock 22. Preferably, the report cover 24 includes front and back covers joined by a hinge and at least one of the covers includes a protrusion adjacent the hinge extending therefrom. The slide lock 22 is preferably made of a high-impact polystyrene or ABS. Preferably, the slide lock is made by extruding the material and then cutting to the desired shape.

Figure 6:
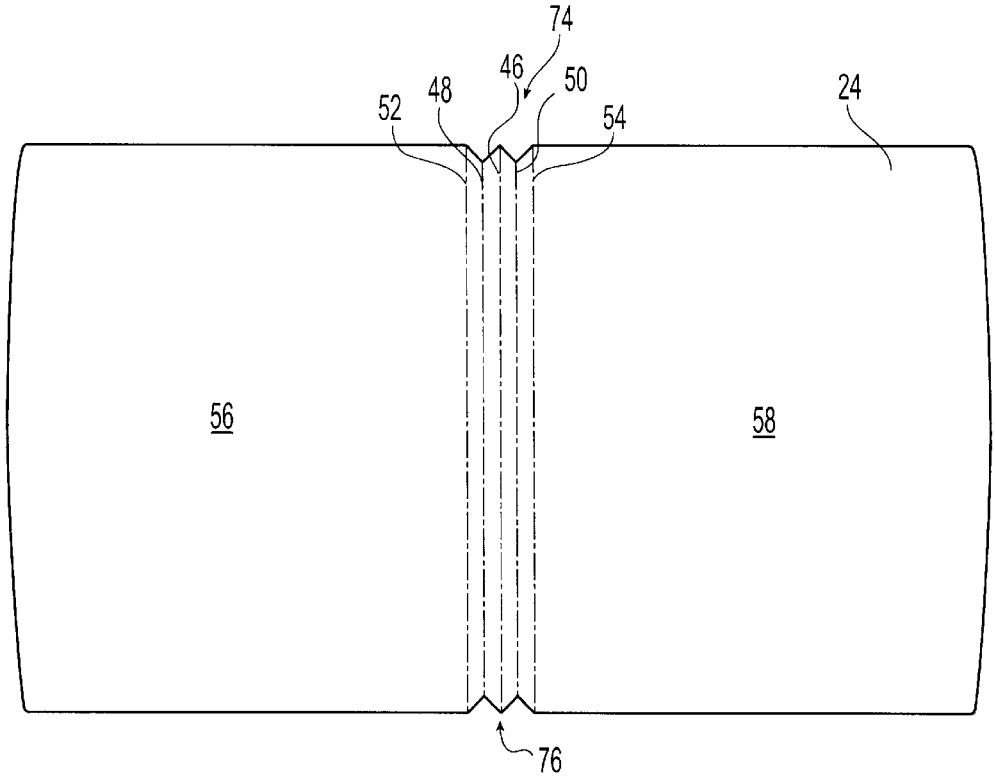
FIG. 6 is front view of a report cover according to the present invention.

An embodiment of a report cover 24 is shown in FIG. 6. This embodiment features five folds 46, 48, 50, 52 and 54 separating a front cover 56 from a back cover 58. The report cover of FIG. 6 is made of a single piece of material, but one cover can be made of a different material and attached to the other cover having the folds. The report cover is preferably made of a semi-rigid PVC or polypropylene. A more flexible material can also be used. In an alternative embodiment, the front cover and the folded part are made of a semi-rigid PVC or polypropylene, and the back cover is formed of a paper product such as cardboard, craft paper, manilla paper or any other paper known to those skilled in the art.

Figure 7:
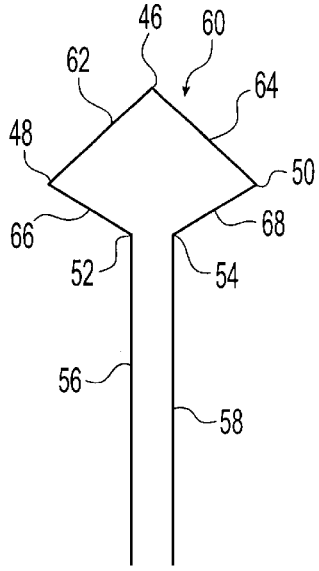
FIG. 7 is an end view of a first embodiment of the report cover as partially folded according to the present invention.
Figure 7A:
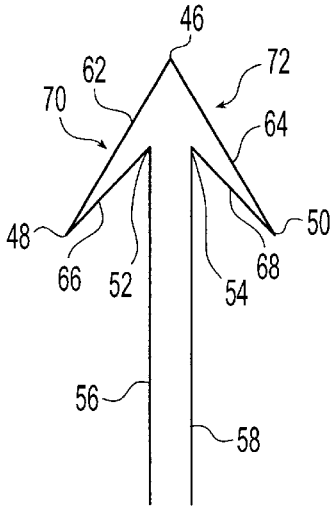
FIG. 7A is an end view of the first embodiment of the report cover as folded according to the present invention.

The report cover 24 features a center fold or hinge 46 separating the front and back covers 56 and 58, and two additional folds 48, 52 and 50, 54 are made on each side of this center fold or hinge 46. As shown in FIG. 7, these folds 46, 48, 50, 52, and 54 are initially folded to form a diamond shape 60. Preferably the first and second folds 48 and 50 and the third and fourth folds 52 and 54 are equidistant from the center fold 46. Between the center fold 46 and the first and second folds 48 and 50 are a first and second fold panels 62 and 64. Also, between the first and second folds 48 and 50 and the third and fourth folds 52 and 54, respectively, are a third and fourth fold panels 66 and 68. Preferably, the first and second fold panels 62 and 64 are wider than the third and fourth fold panels 66 and 68. As shown in FIG. 7A, two flaps 70 and 72 are formed. Flap 70 includes the first and third fold panels 62 and 66 on one side of the center fold 46, and flap 72 includes the second and fourth fold panels 64 and 68 on the other side of the center fold 46. The two flaps 70 and 72 are formed by folding the first and second folds 48 and 50 of the diamond 60 forward of the remainder of the diamond 60 such that the first and second fold panels 62 and 64 are disposed alongside the third and fourth 66 and 68 fold panels, respectively.

Figure 7B:
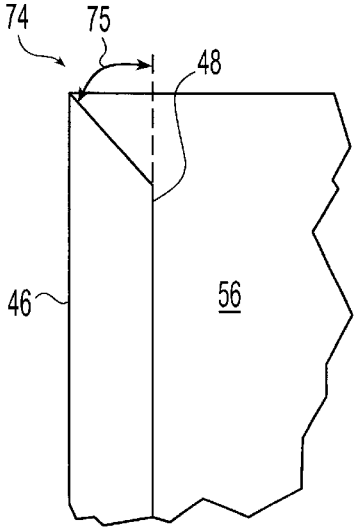
FIG. 7B is a front view of the first embodiment of the report cover as folded according to the present invention.

As shown in FIGS. 6 and 7B, preferably, the upper and lower ends 74 and 76 adjacent the center fold 46 of the report cover 24 are notched toward the first and second folds 48 and 50 of the diamond 60, such that the flaps 70 and 72 tapered at the upper and lower ends 74 and 76 when folded over the covers 56 and 58 to facilitate the mounting of the slide lock 22 thereover without catching on the ends 28 and 30 of the slide lock 22. Preferably, the flaps 70 and 72 are tapered at an angle 75 of less than 85 degrees with respect to a length of the flaps 70 and 72. The tapered sides also help to guide the report cover into the slit of the slide lock. The slide lock 22 is slid over the report cover 24 by inserting one of the notched end 74 and 76 of the report cover 24 within the slit 40 at one of the tapered ends 28 and 30 of the slide lock. The report cover 24 is then slid such that the folds 46, 48, 50, 52, and 54 are completely within the slide lock 22 and that the flaps 70 and 72 remain within the channel 32 of the slide lock 22 to securely hold the report cover 24 within the slide lock 22. The flaps 70 and 72 abut the inner side wall 41 of the slide lock 22 assisting in preventing the report cover 24 from slipping out of the slide lock 22. Preferably, the report cover 24 is manufactured by die-cutting the material to the desired shape. Then the material is folded by applying heat and pressure.

Figure 8:
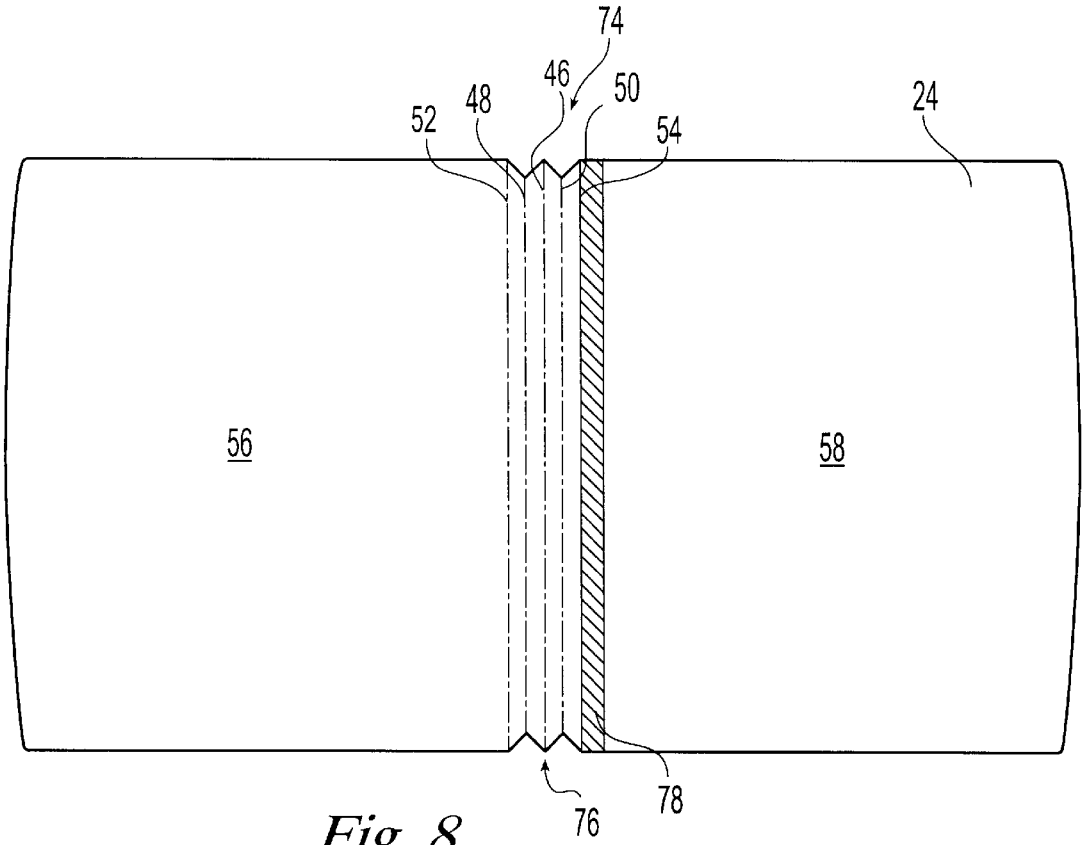
FIG. 8 is a front view of a second embodiment of a report cover according to the present invention.
Figure 9:
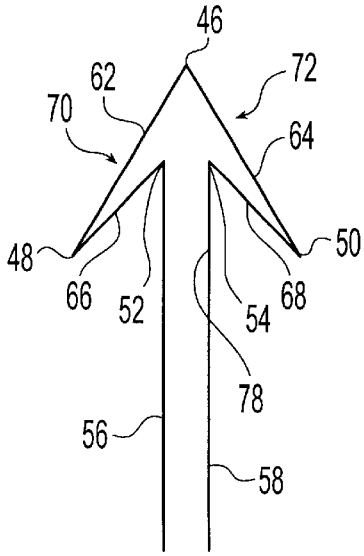
FIG. 9 is an end view of the second embodiment of the report cover as folded according to the present invention.

Another embodiment of the report cover 24 is shown in FIGS. 8–9. The report cover 24 is made of two different materials. The back cover 58 is made of a different material than the front cover 56. Preferably the front cover 56 is made of a semi-rigid PVC or polyethylene and the back cover 58 is made of a paper product such as card board, manilla paper, craft paper and other such paper known to those skilled in the art. An attachment portion 78 is included on each cover 56 and 58 where the covers overlap. Preferably, an adhesive or glue is used on the attachment portion 78 to join the two cover portions 56 and 58 to form the report cover 24. Other fastening devices known to those skilled in the art may be used such as staples, snaps, and heat sealing. As shown in FIG. 9, preferably the front cover 56 features the folds 46, 48, 50, 52, and 54 as described above forming the two flaps 70 and 72 that are insertable within the slide lock 22 to form the report cover 20. The panels 66 and 68 are narrower than panels 62 and 64.

Figure 10:
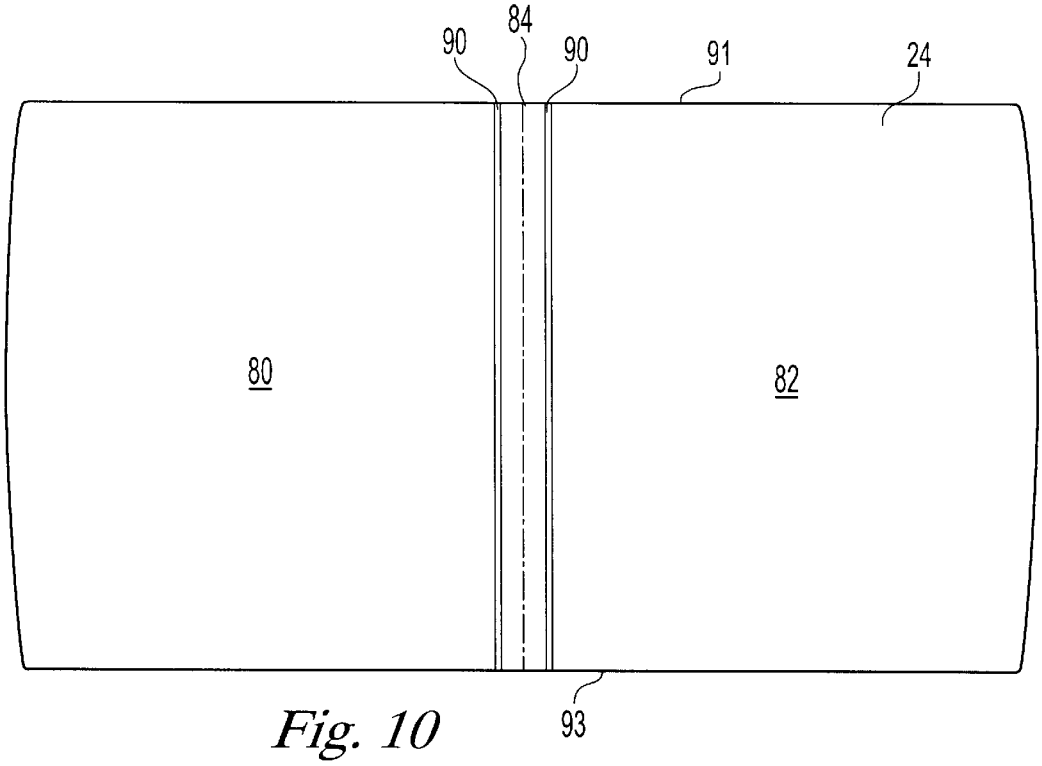
FIG. 10 is a front view of a third embodiment of a report cover according to the present invention.
Figure 11:
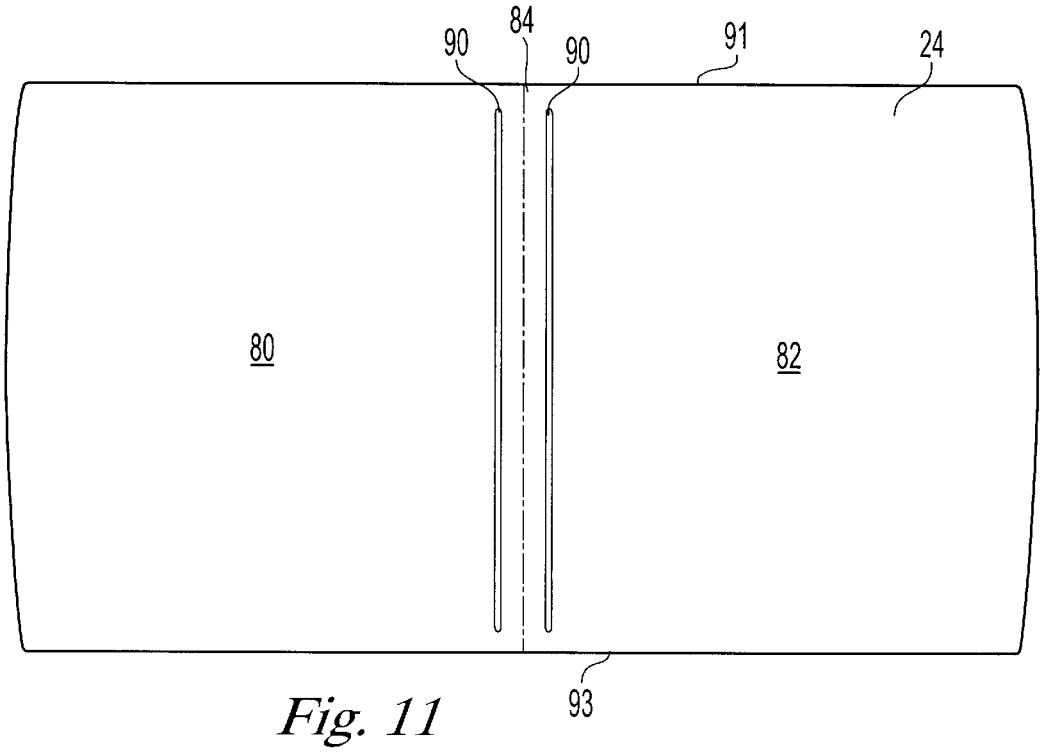
FIG. 11 is a front view of a another version of the third embodiment of the report cover according to the present invention.

FIG. 10 shows the preferred embodiment of the report cover 24. The report cover 24 includes front and back covers 80 and 82 connected by a fold 84. Additional folds may be included to accommodate larger stacks of paper. As shown in FIG. 11, the front and back covers 80 and 82 have inner and outer surfaces 86 and 88. Preferably the report cover 24 is made of a single piece of material such as a semi-rigid PVC or polypropylene. However, different materials, such as those discussed above, can be joined to each other using adhesives or other like methods of attaching report cover sections known to those skilled in the art.

Figure 12:
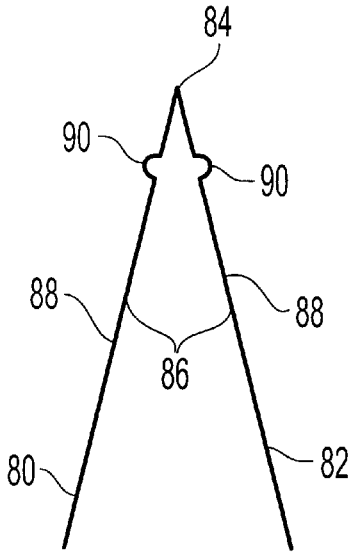
FIG. 12 is an end view of the third embodiment of the report cover according to the present invention.
Figure 12A:
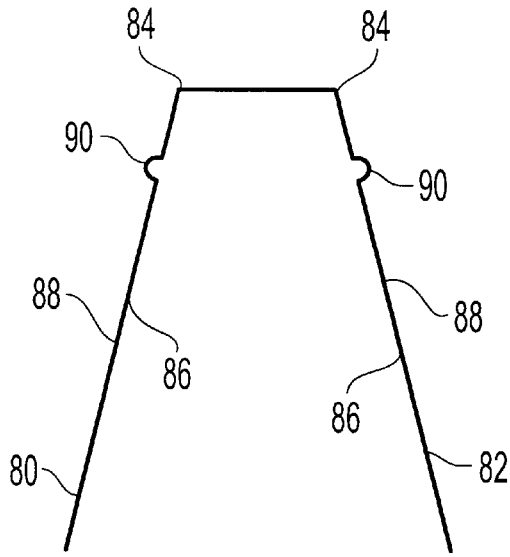
FIG. 12A is an end view of another version of the third embodiment of the report cover according to the present invention.

At least one elongated bump 90 is formed adjacent the fold or hinge 84. Preferably, as shown in FIG. 10, the report cover 24 features a bump 90 on each cover 80 and 82 that extends along the length of the fold 84. As shown in FIG. 11, the bumps 90 can stop short of top and bottom ends 91 and 93 of the report cover 22, such that the bumps 90 do not extend along the entire length of the fold 84. Also, more than one bump 90 can be included on either cover 80 and 82. As shown in FIG. 12, the bumps 90 are formed projecting from the outer surface 88 of the covers. As shown in FIG. 12A, multiple folds 84 are used to accommodate larger stacks of paper. The fold 84 and bumps 90 are insertable within the slide lock channel 32, and assist in preventing the report cover 24 from sliding out of the slide lock 22. The bumps 90 catch on the inner wall 41 and edges 36 and 38 of the slide lock to prevent the report cover from sliding out of the slide lock. The bumps 90 can be of a variety of sizes and shapes so long as they fit within the slide lock 22. For example, the bumps may be rounded, square or triangular shaped or any other shape known to those skilled in the art. Further, many bumps, a few or even a single elongated bump may be provided as shown in FIGS. 10–12A. The report cover 24 is preferably made by die-cutting the material to the desired shape and using heat and pressure to form the fold. The bumps 90 are preferably formed in the report cover 24 using heated rollers.

While the above invention has been described with reference to certain preferred embodiments, it should be kept in mind that the scope of the present invention is not limited to these embodiments. For example, the report cover can be made of three separate pieces, a front cover, a folded section, and a back cover, where each piece is adhesively secured to the adjacent pieces. One skilled in the art may find variations of these preferred embodiments which, nevertheless, fall within the spirit of the present invention, whose scope is defined by the claims set forth below. Thus, is understood that the appended claims are intended to cover all such modifications and embodiments which come within the spirit and scope of the present invention.

We claim:

1. A report cover comprising:

a. front and back covers connected by a hinge and configured to hold a stack of paper, each cover having an outer surface and an inner surface; and b. at least one bump on the outer surface forming an indentation on the inner surface of at least one of the front and back covers adjacent the hinge with substantially flat portions of the cover located on both sides of the bump, wherein the bump defines at least one sharp fold at intersections with the covers and the hinge of the report cover is insertable into a slide lock with the bump configured to catch on an edge of the slide lock to resist extraction of the report cover from the slide lock.

2. The report cover of claim 1, further comprising at least one bump provided on each cover extending along more than about 40% of the hinge.

3. A report cover combination comprising:

a. report cover having, i. front and back covers connected by a hinge;

b. a slide lock comprising, i. two opposed edges separated by a slit; and ii. a first end communicated with the slit and having an end edge sloped toward the slit such that the end edge is operatively associated with the report cover to guide the report cover towards the slit when the report cover is slidably inserted into the slit from the end edge wherein the front and back covers have outer surfaces; and the report cover includes at least one protrusion extending from the outer surface of at least one of the front and back covers and configured and dimensioned for catching against the opposing edges restricting extraction from the side lock, wherein the protrusion is at least one bump formed on the outer surface of at least one cover, formed adjacent the hinge with portions of the outer surface of the cover located on both sides of the bump.

4. The report cover of claim 1, wherein one bump is formed on each front and back covers adjacent the hinge for catching on the opposing edges of the slide lock when the report cover is inserted into the slide lock in order to resist extraction of the report cover from the slide lock.

5. The report cover of claim 1, wherein the at least one bump is formed spaced a distance from the hinge to engage the edge of the slide lock.

6. The report cover of claim 1, wherein the bumps have a rounded cross-section.

7. The report cover of claim 1, wherein the bumps have side walls generally perpendicular to the portions of the cover.

8. A report cover combination, comprising:

the report cover of claim 1; and a slide lock configured for receiving the report cover and having an edge configured and disposed for catching the bump to resist extraction of the report cover from the slide lock.

9. A report cover combination comprising:

a. front and back covers connected by a hinge comprising a sharp fold and configured to hold a stack of paper, each cover having an outer surface and an inner surface;

b. at least one bump on the outer surface forming an indentation on the inner surface of at least one of the front and back covers and defining sharp folds at intersections with the covers, the bump being spaced apart from the hinge; and c. a slide lock having an edge and being configured for receiving the report cover in a position to catch the bump on the edge of the slide lock to resist extraction of the report cover from the slide lock.

10. The report cover of claim 1, wherein the hinge comprises a sharp fold.

* * * * *